US005697433A

United States Patent [19]

Kato

[11] Patent Number: 5,697,433

[45] Date of Patent: Dec. 16, 1997

[54] HEAT-EXCHANGER CONDUIT FOR TUBE-STACKING TYPE HEAT EXCHANGER AND METHOD OF MANUFACTURING IT

[75] Inventor: Soichi Kato, Konan-machi, Japan

[73] Assignee: Zexel Corporation, Tokyo, Japan

[21] Appl. No.: 361,213

[22] Filed: Dec. 21, 1994

[30] Foreign Application Priority Data

Dec. 21, 1993 [JP] Japan ..... 5-322876
Sep. 30, 1994 [JP] Japan ..... 6-238242

[51] Int. Cl.[6] ..... F28F 3/14

[52] U.S. Cl. ..... 165/170; 165/153; 165/166; 165/177

[58] Field of Search ..... 165/177, 170, 165/166, 153, 176

[56] References Cited

U.S. PATENT DOCUMENTS

| | | | |
|---|---|---|---|
| 3,810,509 | 5/1974 | Kun | 165/153 X |
| 4,470,452 | 9/1984 | Rhodes | 165/153 |
| 4,570,700 | 2/1986 | Ohara et al. | 165/177 X |
| 5,111,877 | 5/1992 | Buchanan et al. | 165/176 X |
| 5,125,453 | 6/1992 | Bertrand et al. | 165/176 X |
| 5,186,250 | 2/1993 | Ouchi et al. | 165/177 |

FOREIGN PATENT DOCUMENTS

| | | | |
|---|---|---|---|
| 0066091 | 4/1986 | Japan | 165/177 |
| 4032697 | 2/1992 | Japan | 165/153 |
| 4086489 | 3/1992 | Japan | 165/177 |
| 2223091 | 3/1990 | United Kingdom | 165/177 |

*Primary Examiner*—Denise L. Ferensic
*Assistant Examiner*—Christopher Atkinson
*Attorney, Agent, or Firm*—Kanesaka & Takeuchi

[57] ABSTRACT

The invention provides a flat tube for a heat-exchanger conduit capable of being properly brazed and provides a sufficient heat-resistance, and a method of manufacturing it. A tube-stacking type heat exchanger comprising a plate made of an aluminum material including an aluminum alloy and which is cladded with a brazing material, wherein either a single plate is folded into two or two plates are placed one upon the other, the surface of one or both plates including projecting portion projecting from the surface of one plate to the surface of the other plate, the projecting portion is brought into pressure contact with the flat surface of the other plate or the projecting portion of the other plate, and the height of the end edge connecting portions of the plate is dimensioned smaller than the height of the projecting portion, to achieve the joining of the end edge connecting portions of the plate together.

5 Claims, 17 Drawing Sheets

HEAT-EXCHANGER CONDUIT FOR TUBE-STACKING TYPE HEAT EXCHANGER AND METHOD OF MANUFACTURING IT

[INDUSTRIAL FIELD OF UTILIZATION]

The present Invention relates to a heat-exchanger conduit for a tube-stacking type heat exchanger comprising heat-exchanger conduits of flat tubes or flat pipes being stacked one upon another and a method of manufacturing the conduit.

[TECHNICAL BACKGROUND]

The conventionally known tube-stacking type heat exchanger comprises flat tubes serving as heat-exchanger conduits being stacked one upon another, their ends are connected with collection and distribution means of a header tank, and a heat exchanger medium flows between an inlet joint and an outlet joint of the header tank in a zig zag form.

The aforementioned type of flat tube for such tube-stacking type heat exchanger is known, for example, as disclosed in (1) Japanese Patent Laid-Open Publication No. 3(1991)-155422 and (2) Japanese Utility Model Laid-Open Publication No. 59(1984)-59688.

The tube disclosed by the above-mentioned prior art (1) is such, that as shown in FIG. 18, a flat tube 25 is formed by a single plate 26 of a predetermined size having a plurality of projecting portions (for example, beads) 27, and the single plate 26 being folded into two at a folding portion 28 at the center and the connecting portions 29, 29 of the ends are joined together by brazing.

The tube disclosed by the above-mentioned prior art (2) is such, that as shown in FIG. 19, a flat tube 30 comprises two plates 31 and 32 being placed one upon the other, each plate having a plurality of projecting portions (for example, beads) 27 projecting inwardly with their forward ends in pressure contact with projecting portions of the other plate, and connecting portions 33, 33 of the ends of the plates 31, 32 are joined together by brazing.

With the flat tubes 25 and 30 respectively of the above-mentioned prior art (1) and (2), the plurality of beads 27 cause a turbulence in the heat-exchanger medium flowing through the tube so as to provide a higher heat-exchanger efficiency and to increase the strength of the flat surfaces of the tube thereby to improve the pressure-resistance.

Further, with both of the prior art flat tubes 25 and 30, the height c from the flat surfaces of both tubes to the respective connecting portions 29, 33 is dimensioned uniformly in the direction of a width of the flat tube, and, accordingly the height of the bead 27 is also dimensioned the same. Then, the ends of the flat tubes are inserted into tube insertion holes of the header tank and connected with the header tank by brazing them together to form the heat exchanger.

FIG. 20 shows a tube-stacking type heat exchanger 40 of so-called a single-sided tank type heat exchanger. This tube-stacking type heat exchanger 40 is formed by a plurality of flat pipes 41 serving as heat-exchanger conduits being stacked one upon another. For example, two plates 42 as shown in FIG. 21 for flat pipes and two plates 42 as shown in FIG. 22 for flat pipes are combined to form a single flat pipe. Then, a plurality of thus formed flat pipes are coupled in such manner that each plate of the pipe is placed back-to-back with the plate of adjacent pipes. These plates 42 are formed by a press forming, each having at its one end recesses 43, 44 for forming the tank, a U-turn shape fluid passage 45 communicating with the recesses 43, 44, and a partition ridge 46 for forming the U-turn shape fluid passage 45. The flat pipe of FIG. 22 has, additionally, a plurality of beads 47, 47 provided around the partition ridge 46.

Since the single flat pipe 41 is comprising two plates 42, the pipe of FIG. 21 is formed by brazing the portions of end edge connecting portions 48 and the partition ridge 46, and the pipe of FIG. 22 is formed by brazing the portions of end edge connecting portions 48, the partition ridge 46 and the beads 47 together integrally at the same time.

However, in the tube-stacking type heat exchanger constructed by using the flat tube of the above-mentioned prior art (1) or (2), some of the beads provided at the center in the direction of width of the flat tube were not brazed during brazing, which inconveniently causes a disadvantage of not being suitable for use as a condenser in respect of heat-resistance.

This is because, during brazing, while the connecting portions of end edges of plates can be properly and sufficiently brazed, since not only the brazing material on the outer surface of the plate, but also the brazing material on the inner surface of the plate enter into the connecting portions of end edges of plates, the beaded portion where beads are provided at the center in the direction of width of the flat tube is not properly brazed, because only the brazing material on the inner surface of the plate enters into the portion where the forward ends of the beads are in pressure contact, or a small gap may be formed at the portion where the forward ends of the beads are in pressure contact, or due to decrease of wall thickness caused by melting of brazing layer of the brazing sheet during brazing, or unevenness of height of beads.

Further, the above-mentioned prior art has a disadvantage that poor brazing of beads cannot be found.

A further drawback of the above-mentioned prior art is that proper insertion and securing of inner corrugated fins cannot be confirmed when inserting inner fins into the flat tube.

In addition, the above-mentioned single-sided tank type heat exchanger also has the same drawback that poor brazing occurs at the partition ridge portion or beaded portion, but such poor brazing cannot be found.

The present invention provides an improved heat-exchanger conduit for the tube-stacking type heat exchanger and a method of manufacturing it which is capable of providing an assured brazing of beads arranged at the center in the direction of width of the heat-exchanger conduit, the inner fins, or the partition ridge provided in the heat-exchanger conduit, even in the heat-exchanger conduit formed with a single plate by folding it into two or two plates being placed one upon the other, so as to provide a sufficient pressure-resistance, and to facilitate finding of poor brazing.

[DISCLOSURE OF THE INVENTION]

The present invention relates to a heat-exchanger conduit for a tube-stacking type heat exchanger comprising a plate made of an aluminum material including an aluminum alloy and which is cladded with a brazing material, wherein either a single plate is folded into two or two plates are placed one upon the other, and the end edges of the plates are connected together by brazing, the conduit is characterized in that projecting portions are formed on the flat surface of one of the plates or the flat surfaces of both plates facing each other, the projecting portions being projected inwardly towards the surface of the other plate;

the projecting portions are brought into pressure contact with the flat surface of the other plate or with the projecting portions of the other plate and the end edge connecting portions of the plates are connected by brazing; and wherein the height of end edge connecting portion of the plate is dimensioned smaller than the height of the projecting portion.

The present invention further relates to a method of manufacturing a heat-exchanger conduit for a tube-stacking type heat exchanger comprising a plate made of an aluminum material including an aluminum alloy and which is cladded with a brazing material and inwardly projecting projections are provided on the flat surface of the plate, wherein either a single plate is folded into two or two plates are placed one upon the other, and the end edges of the plates and the forward ends of the projections are connected together by brazing, the method is characterized by the steps of the end edge connecting portions are formed by a press forming with the height thereof being dimensioned smaller than the height of the projections;

the ends of the conduit are inserted into insertion holes provided in a header tank; and the end edge connecting portions of the plates are connected and the forward ends of the projections with one another, respectively, by brazing them together.

The present invention still further relates to a method of manufacturing a heat-exchanger conduit for a tube-stacking type heat exchanger comprising a plate made of an aluminum material including an aluminum alloy and which is cladded with a brazing material, wherein either a single plate is folded into two or two plates are placed one upon the other and fins are inserted therein, and joining the end edges of the plates together and the inner fins with the plate by brazing, the method is characterized by the steps of forming the end edge connecting portions by a press forming with the height thereof being dimensioned smaller than one half of the height of the plate with the inner fins inserted;

inserting the ends of the conduit into insertion holes provided in a header tank; and joining the end edge connecting portions of the plates together and the inner fins with the plate, respectively, by brazing them together.

In such heat-exchanger conduit, corrugated fins are interposed between adjacent conduits by means of a jig and a plurality of conduits are assembled in a stacked form. Thereafter, projections of the conduit are joined together (for example, joining the beads with one another, the beads of one of the plates with the other plate, or the inner fins with the plate or still further the partition ridge with the plate) and joining the end edge connecting portions with each other, by brazing them integrally at the same time.

With the heat-exchanger conduit of the present invention, the height of the end edge connecting portions of the plate is dimensioned smaller than the height of the projections (namely, the height of beads, one half of the height of the plate with the inner fins being inserted, or the height of the partition ridge). Consequently, constraint under the assembly work becomes particularly greater at the portions where the beads are brought into pressure contact with one another, where the inner fins are in pressure contact with the plate or in the partition ridge, so that, during integrally brazing process, the projecting portions are joined together firmly by the brazing material of the inner surface of both plates, and the brazing material of the inner and outer surfaces of the plate enter into the end edge connecting portions, so that, even if a gap is formed between the end edge connecting portions, the gap is filled with the brazing material to assure the reliable joining of the end edge connecting portions of the plate.

Thus, with the present invention, the projecting portions of the heat-exchanger conduit are preferentially brazed, thereby, to assure the firm brazing of beads with one another, the beads of one of the plates with the other plate, or inner fins with the plate, and further, the partition ridge with the plate. As a result, the heat-resistance of the heat-exchanger conduit is improved so as to be used as a condenser satisfactorily. Further, with such preferential brazing of the projecting portions of the heat-exchanger conduit, poor brazing is difficult to be caused in brazing the beads with one another, the beads of one of the plates with the other plate or the inner fins with the plate, and further the partition ridge with the plate. But, poor brazing is caused rather in joining the end edge connecting portions. Thus, if poor brazing of the end edge connecting portions is caused, it can be found by visual observation, or noticed by leakage of fluid during inspection of an assembled heat exchanger by flowing the fluid therethrough, so that the present invention allows easy finding of poor brazing.

[BEST MODE FOR CARRYING OUT THE INVENTION]

Now the present invention will be described by way of embodiments shown in the accompanying drawings.

Figure 1:
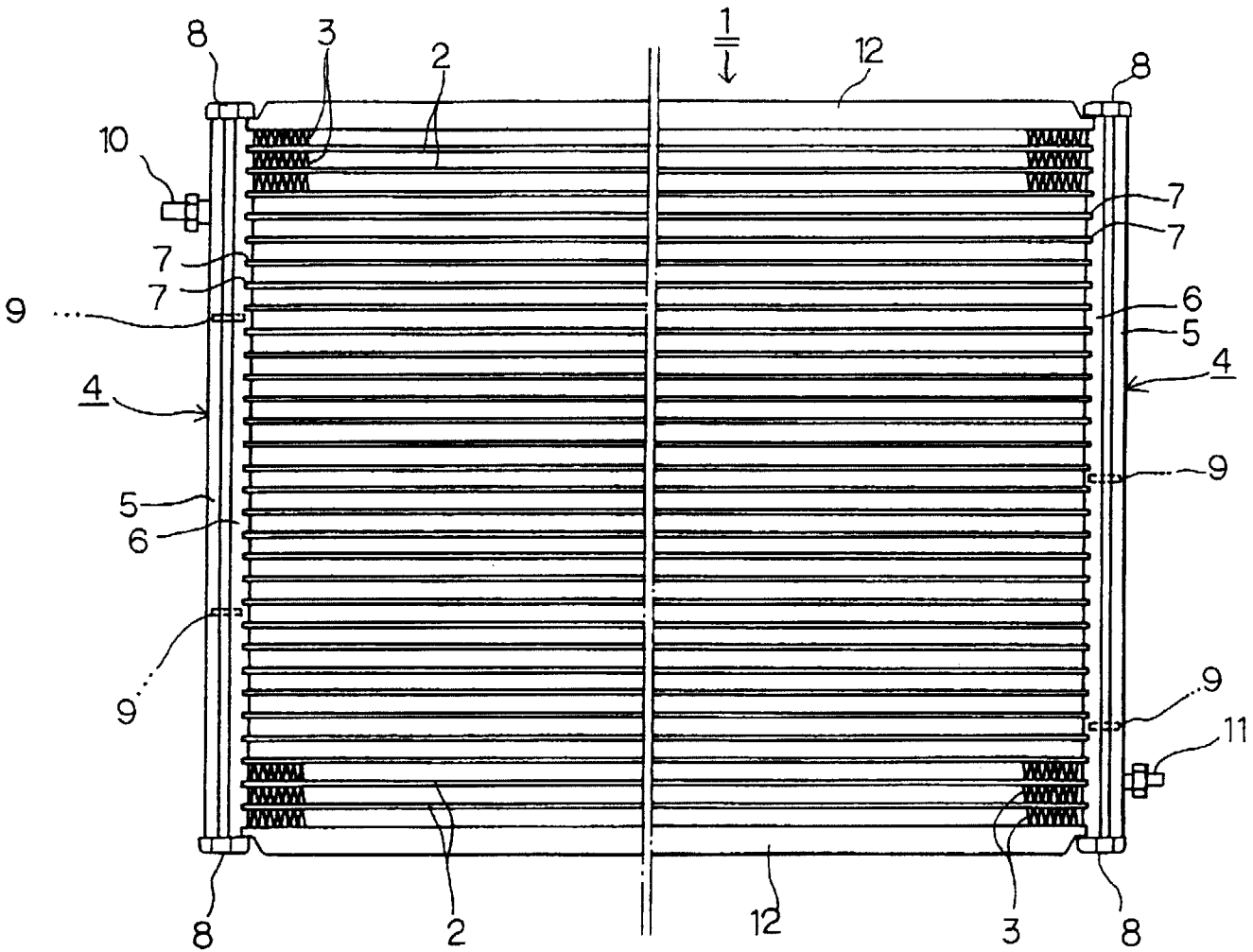
FIG. 1 is a front view of a tube-stacking type heat exchanger of an embodiment of the present invention.

Referring to FIG. 1, a tube-stacking type heat exchanger 1 of this embodiment is comprising a plurality of heat-exchanger conduits, i.e. flat tubes 2 in this embodiment, being stacked with corrugated fins 3 interposed between adjacent flat tubes 2, and the ends of these flat tubes are inserted into insertion holes 7 provided in each header tank 4. An opening at the upper and the lower portions of each header tank 4 is covered with a blank cap 8, and partition plates 9 are positioned at predetermined places in each header tank 4. Further, the header tank 4 is provided with either an inlet joint 10 or an outlet joint 11, and a heat-exchanger medium flows between the inlet and outlet joints 10 and 11 in a zig-zag form. In the drawings, numerals 5 and 6 respectively designate a tank plate and an end plate constituting the header tank 4, and numeral 12 designates a side plate arranged respectively at the upper and the lower sides of the flat tube 2.

Figure 2:
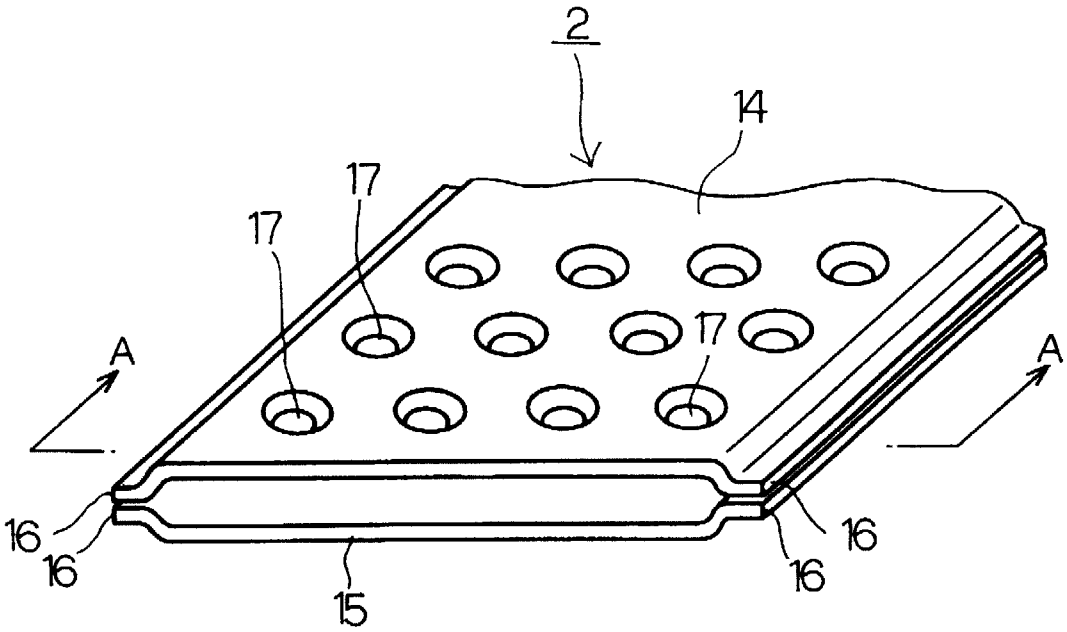
FIG. 2 is a perspective view of a flat tube.
Figure 3:
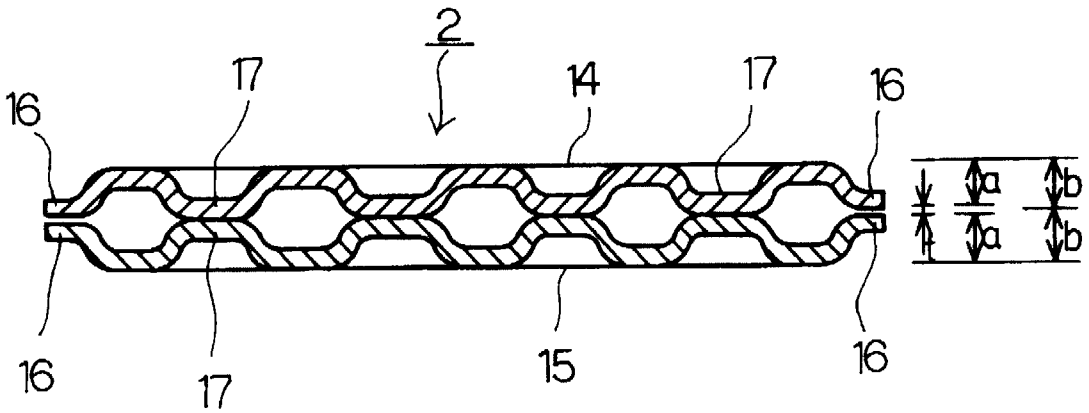
FIG. 3 is a sectional view of the flat tube in the direction of arrows along the line A—A of FIG. 2.

Referring to FIGS. 2 and 3, each flat tube 2 comprises two plates 14 and 15 which are placed one upon the other and which are formed in a size larger than a predetermined size and formed into the flat tube by, for example, a press forming. Each plate 14, 15 includes longitudinal connecting portions 16, 16 at both sides, and each flat surface is formed to swollen outwardly. On each flat surface, there are provided a plurality of projections, i.e. circular beads 17 in this embodiment, projecting inwardly so that forward ends of the beads 17 are in pressure with that of the other plate.

The beads 17 are, as shown in FIG. 2, provided up to the end of the flat tube 2, the end of which is inserted into the insertion hole of the header tank 4. Due to the presence of the beads 17, a turbulence is caused in the heat-exchanger medium passing through the tube, thereby to improve the heat exchanger efficiency, and increases the strength of the flat surface of the tube, results in improving the heat-resistance of the heat exchanger.

Further, as shown in FIG. 3, the height a of connecting portions 16, 16 provided at both sides of the flat tube 2, namely, a thickness from the flat surface to the connecting portion 16, is dimensioned smaller than the height b of each bead 17. These portions are formed by the press forming or the like.

In this embodiment, a difference t between the height b of the bead 17 and the height a of the connecting portion 16 is set, for example, in the order of t=0.02–0.1 mm.

Figure 4:
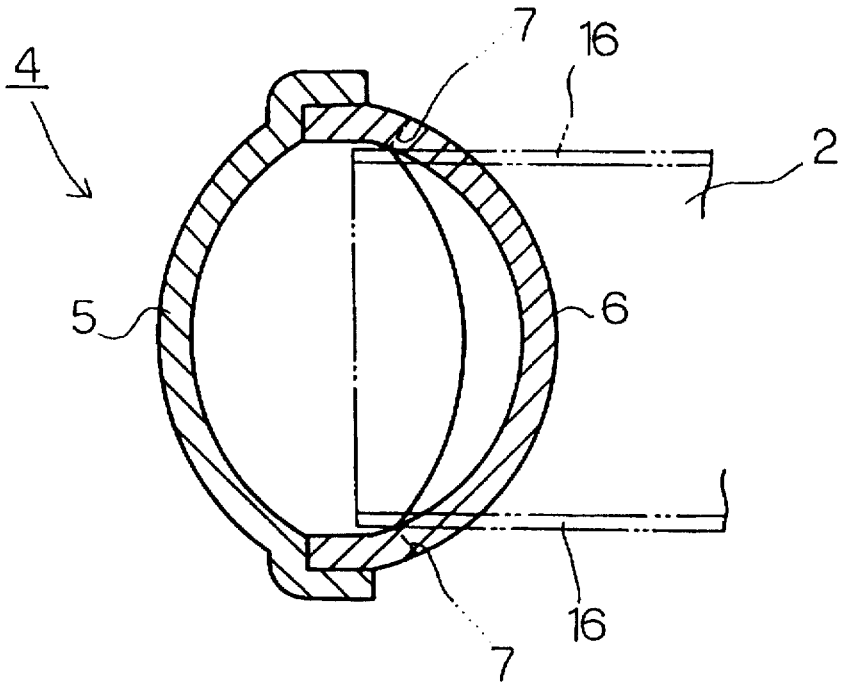
FIG. 4 is a cross-sectional view of the flat tube being inserted into the insertion hole of the header tank.

In such tube-stacking type heat exchanger 1, at the time of inserting the tube 2 into the insertion hole 7 of the header tank 4, the corrugated fins are interposed between the adjacent flat tubes 2 by utilizing a jig, and a plurality of flat tubes 2 are stacked. The insertion ends of each flat tube 2 are inserted into the insertion holes 7 of the header tank 4, as shown in FIG. 4, and, thereafter, the beads 17 with one another and the connecting portions 16, 16 of the flat tube 2 with each other, and further, the ends of the flat tube 2 and the insertion hole 17 are respectively joined together by brazing them integrally at the same time.

Figure 5:
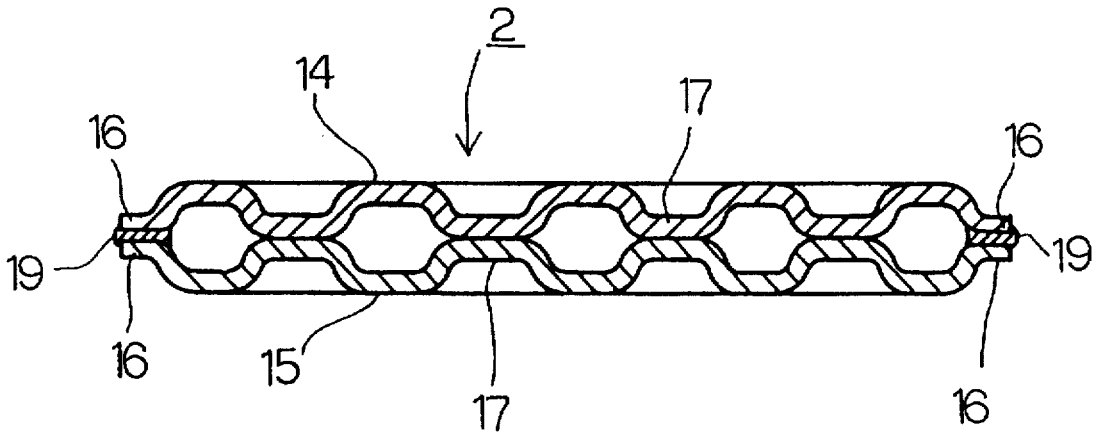
FIG. 5 is a cross-sectional view of the flat tube after brazing.

At this point, when the flat tube 2 is inserted into the insertion hole 7 of the header tank 4, the forward ends of the beads facing each other are brought into contact with each other under the pressure of the insertion hole 7, because the height a of the connecting portion 16 is smaller than the height b of the bead 17, and a very small gap is formed between the connecting portions 16, 16 at the both sides of the flat tube 2. And, during brazing of these portions integrally at the same time, the beads 17 are joined together first by the brazing material of the inner surfaces of both plates 14 and 15, and the brazing material 19 of both inner and outer surfaces of the plates 14 and 15 enters into the gap between the connecting portions 16, as shown in FIG. 5, thereby to fill the gap and provides the firm joining of the connecting portions 16.

Thus, according to this embodiment, the beads of the flat tube which is inserted into the insertion hole of the header tank are brazed first, because the height of the connecting portions is smaller than the height of the beads, so as to assure the brazing of beads with one another. Consequently, the pressure-resistance of the flat tube is improved and the heat exchanger is made possible to be sufficiently suitable as a condenser.

Because of the beads of the flat tube being brazed preferentially, the undesirable poor brazing, if it were to occur, would not occur in brazing the beads, but rather in brazing the connecting portions. If such poor brazing occurred in the connecting portions, it can be noticed by visual observation, or by leakage of fluid during inspection of the assembled heat exchanger by flowing the fluid therethrough.

Figure 6:
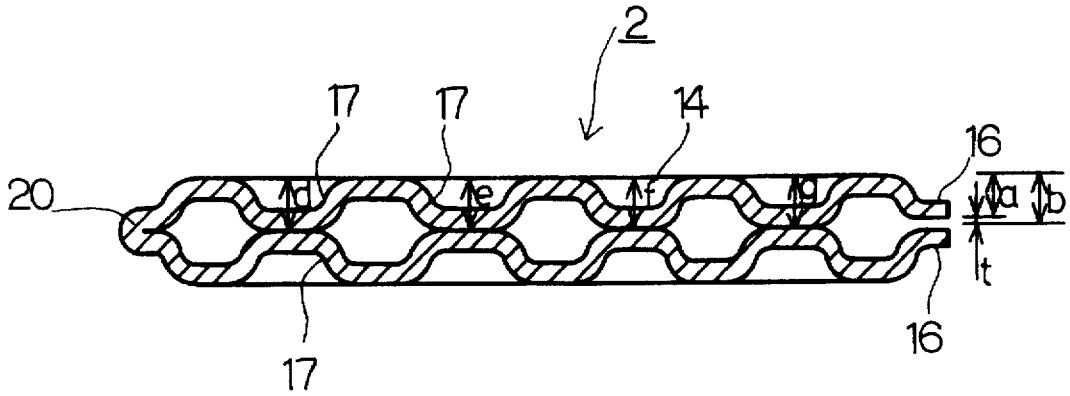
FIG. 6 is a cross-sectional view of the flat tube of another embodiment of the present invention.

In the above-described embodiment, the flat tube 2 is formed by two plates 14 and 15 being placed one upon the other. However, forming of the flat tube is not limited to this, but a single plate 14 may be used by folding it into two at the center as shown in FIG. 6. In FIG. 6, numeral 17 designates beads, 16 designates connecting portions, and 20 designates a folding portion.

Figure 7:
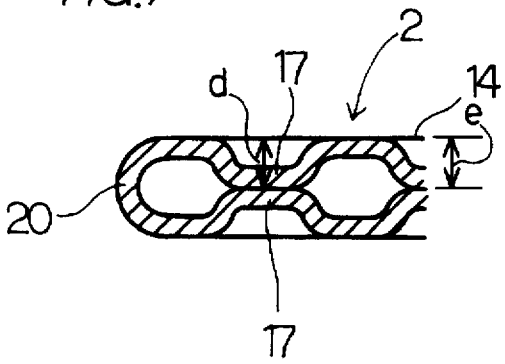
FIG. 7 is a cross-sectional view of the flat tube of a further embodiment of the present invention.

In the case of folding type flat tube 2, a flat tube 2, as shown in FIG. 7, with the folding portion 20 being curved may also be used.

Figure 23:
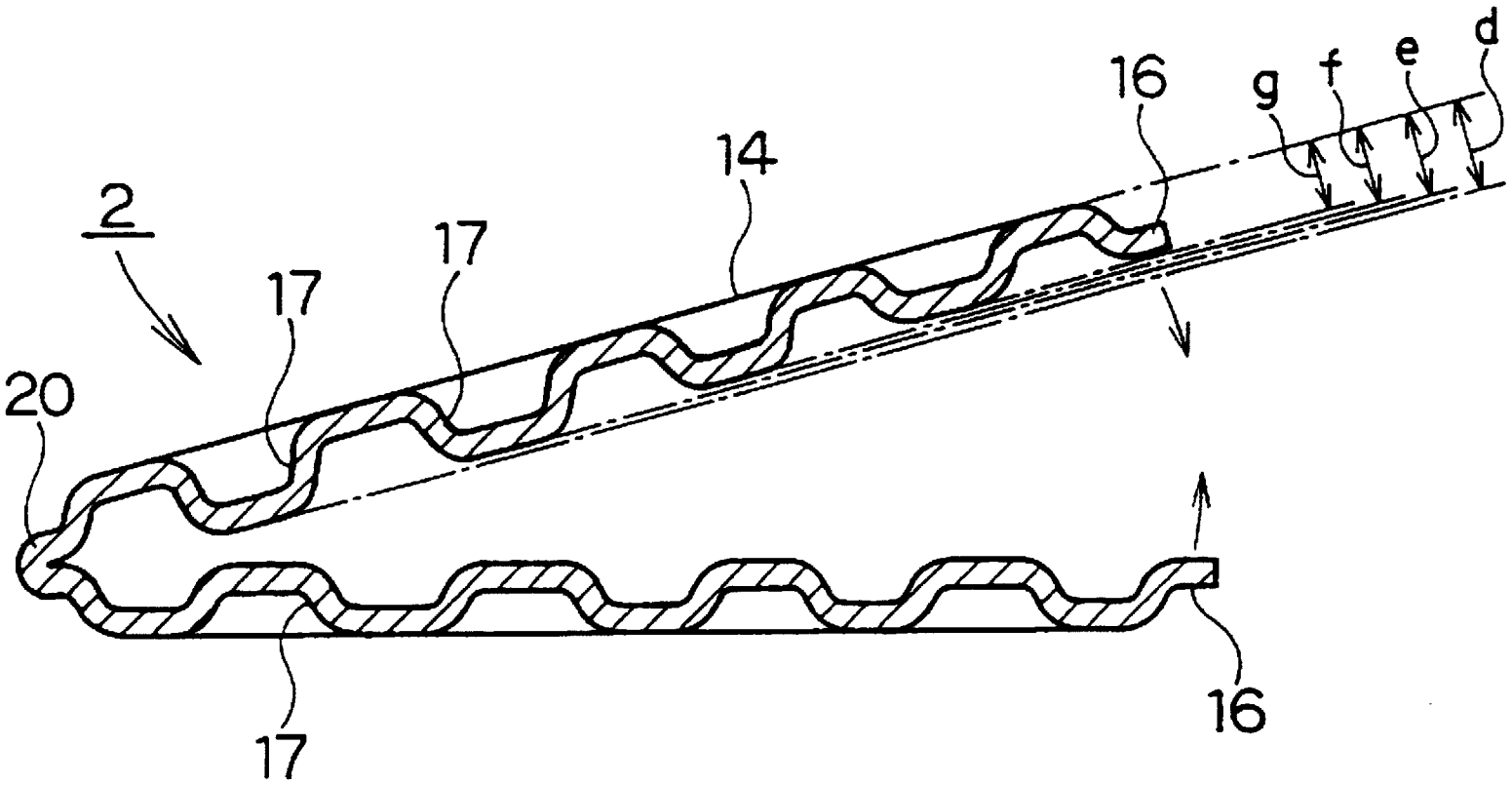
FIG. 23 is a cross-sectional view of the flat tube of still another embodiment.

With the flat tubes 2 as respectively shown in FIGS. 6 and 23, one side is continued at the folding portion 20. Then, of a plurality of beads, the beads which are located from the folding portion 20 to the connecting portion 16 may be dimensioned in the following manner, namely, assuming that the height of each bead is d, e, f and g, then, it may be dimensioned as d=e=f=g>a, or d>e>f>g>a.

Figure 8:
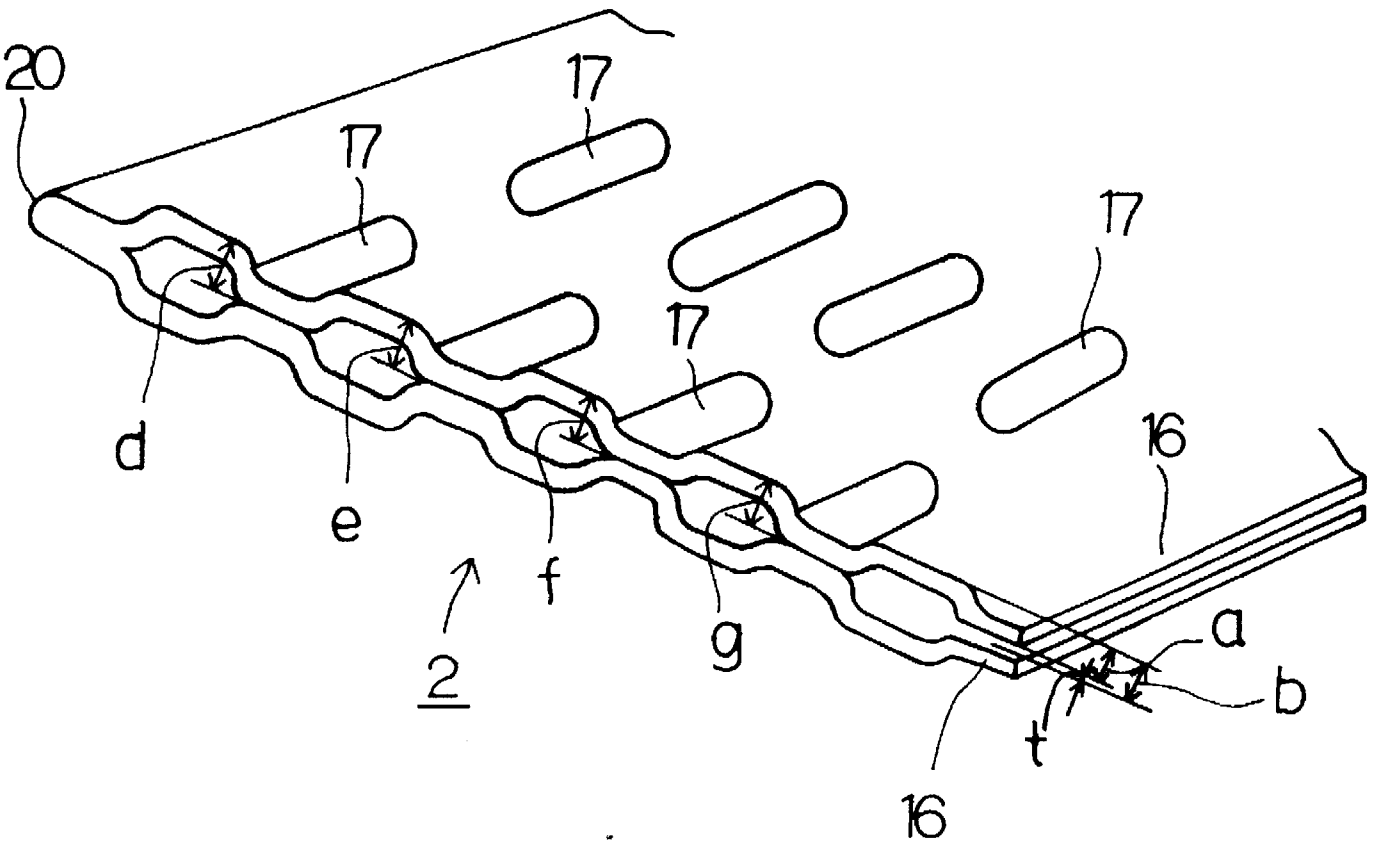
FIG. 8 is a perspective view of the flat tube of a still further embodiment of the present invention.

The foregoing embodiments have been described with the beads 17 in circular form, as an example. However, the shape of beads is not limited to such circular form, but they may be formed in elliptic cylindrical form, as shown in FIG. 8. Further, with the above-described embodiments, the beads are brazed with one another, but it is apparent that the beads may also be brazed with the surface of the other plate.

Figure 9:
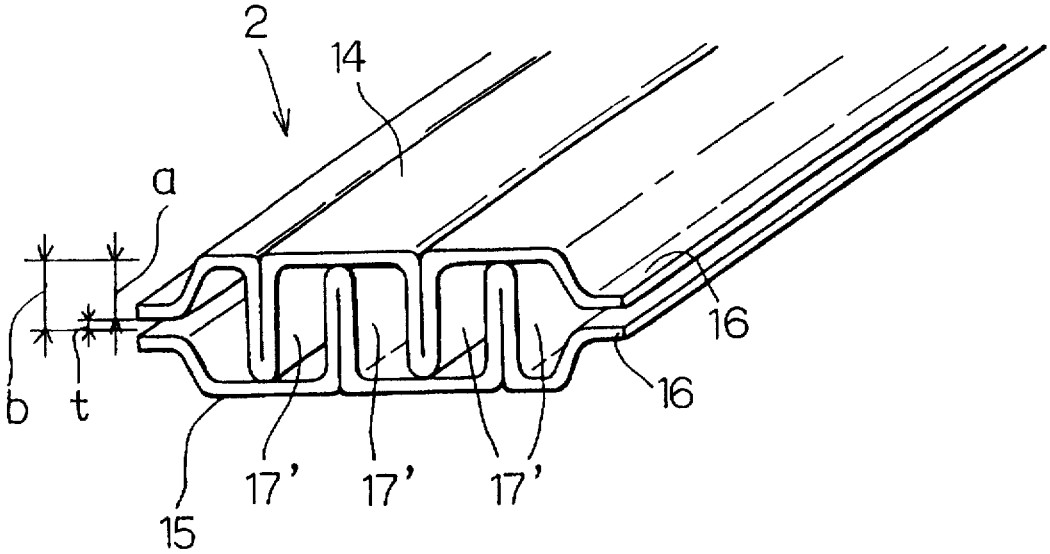
FIG. 9 is a perspective view of the flat tube of still another embodiment of the present invention.
Figure 10:
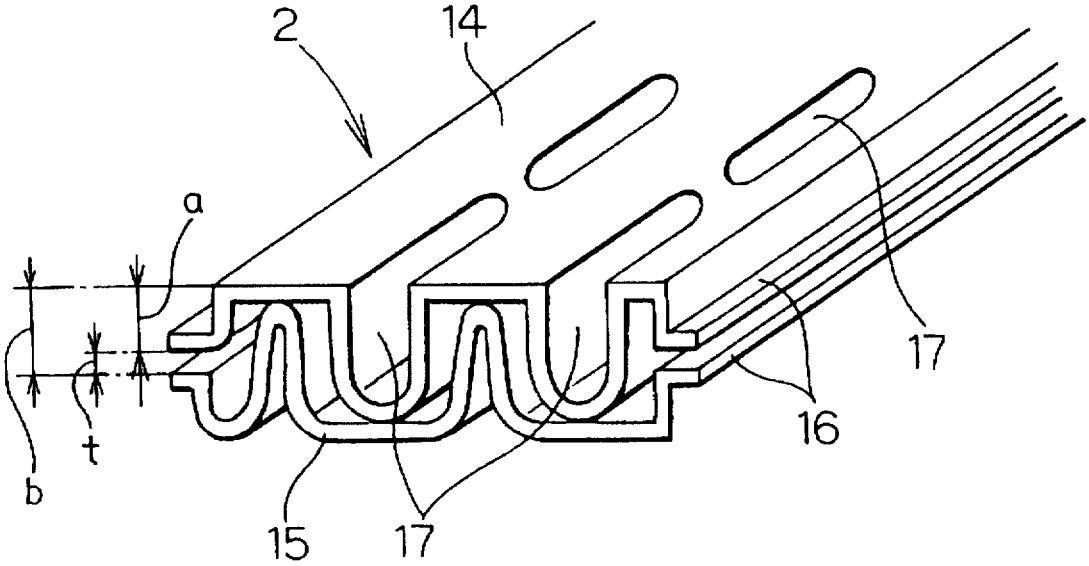
FIG. 10 is a perspective view of the flat tube of another embodiment of the present invention.
Figure 11:
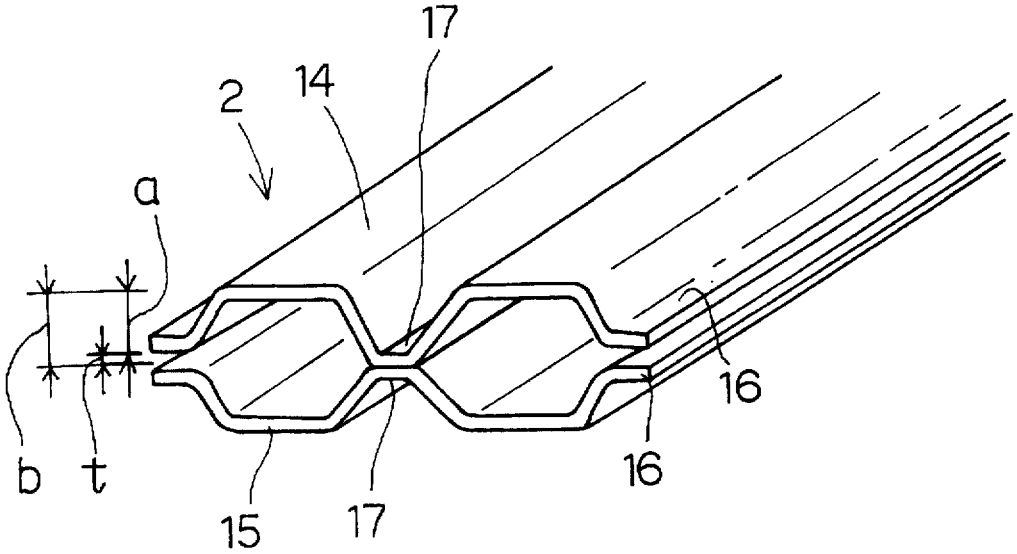
FIG. 11 is a perspective view of the flat tube of another embodiment of the present invention.

FIGS. 9 to 11 show another embodiments of the invention. As in the case of the above-described embodiments, two plates 14 and 15 of a predetermined size formed by a press forming are placed one upon the other. Each plate 14, 15 has the connecting portions 16, 16 at both sides along a longitudinal direction.

With the embodiments of FIGS. 9 AND 10, the flat surface is formed to swollen outwardly, and a plurality of projections, for example, bent ridges 17' and beads 17 in these embodiments, having their forward ends projecting inwardly and in pressure contact with one another, are provided on each flat surface.

The embodiment of FIG. 11 is so constructed that the flat surface of each plate is swollen outwardly and the projecting portion projecting inwardly from the inner surface is provided to be in pressure contact with the projecting portion of the other plate. In this embodiment, the projecting portions are bent ridges with their bent surfaces in pressure contact with each other to form a plurality of continuous beads.

In the embodiments of FIG. 9 AND 10, similar to the above-described embodiments, the height a of connecting portions 16, 16 at either side of the flat tube 2, namely, the thickness from the flat surface to the connecting portion 16, is dimensioned smaller than the height b which is one half of the height of tube. Similarly, in the embodiment of FIG. 11, the height a is smaller than the height b of each bead. These embodiments are for the flat tube 2 formed by two plates 14 and 15 being placed one upon the other. However, these dimensions of heights may also be applied for the flat tube formed by a single plate being folded into two at the center thereof.

Consequently, the embodiments shown in FIGS. 9 to 11 also provide the same effects as that of the aforementioned embodiments.

Figure 12:
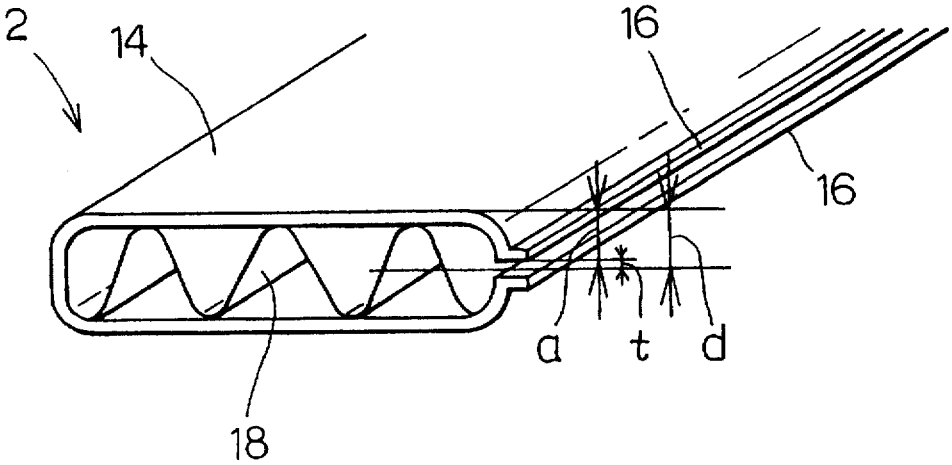
FIG. 12 is a perspective view of the flat tube of another embodiment of the present invention.
Figure 13:
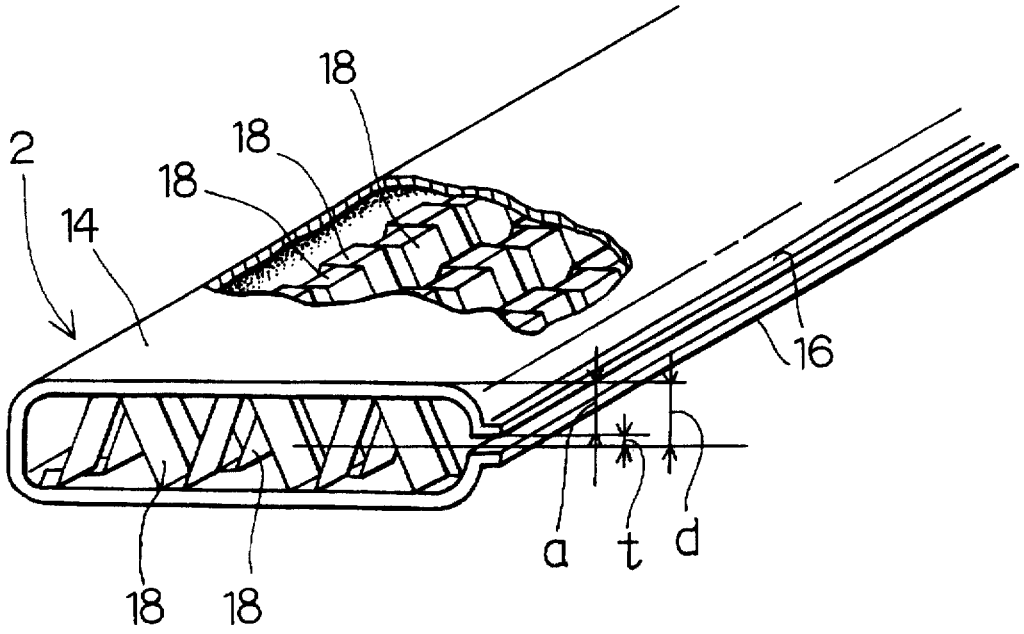
FIG. 13 is a perspective view of the flat tube of still another embodiment of the present invention.

FIGS. 12 and 13 show further embodiments of the invention. Similar to the above-described first embodiment, a single plate 14 of a predetermined size formed by a press forming is folded into two at the center. The plate 14 has connecting portions 16, 16 at one side along a longitudinal direction, and includes inner fins 18 inserted therein.

In the embodiment of FIG. 12, the inner fins 18 are formed in a single body and in elongation. The height a of the end edge connecting portions of the plate 14 is smaller than the height d which is one half of the height of plate 14 with the inner fins 18 being inserted. The ends of the flat tube 2 are inserted into insertion holes 7 provided in header tanks 5 and 6 which distribute and collect the heat-exchanger medium, and the end edge connecting portions of the plate and the inner fins 18 with the plate are joined, respectively, by brazing the tube with the header tanks integrally at the same time.

The embodiment shown in FIG. 13 comprises inner fins 18, 18 which are divided into a plurality of fins in a longitudinal direction, and adjacent fins 18, 18 are so positioned to be shifted from each other to right and left. With this arrangement of inner fins 18, 18, a turbulence is caused in the heat-exchanger medium flowing through the tube, thereby to enhance the heat exchange efficiency. Further, with the presence of these inner fins 18, 18, the strength of the flat surfaces of tube are increased so as to improve the heat-resistance. The height a of the end edge connecting portions is smaller than the height d which is one half of the height of the plate 14 with the inner fins 18 being inserted, thereby the end edge connecting portions and the inner fins 18 with the plate 14 are joined together by inserting the ends of the flat tube 2 into the insertion holes 7 of the header tanks 5 and 6, and brazing them together.

Thus, similar to the above described embodiments, the embodiments of FIGS. 12 and 13 also provide the same effects. Further, the embodiments of FIGS. 12 and 13 have been described for the flat tube formed by a single plate being folded into two at the center, but it is apparent that these embodiments may also be applied for the flat tube formed by two plates 14 and 15 being placed one upon the other.

Figure 14:
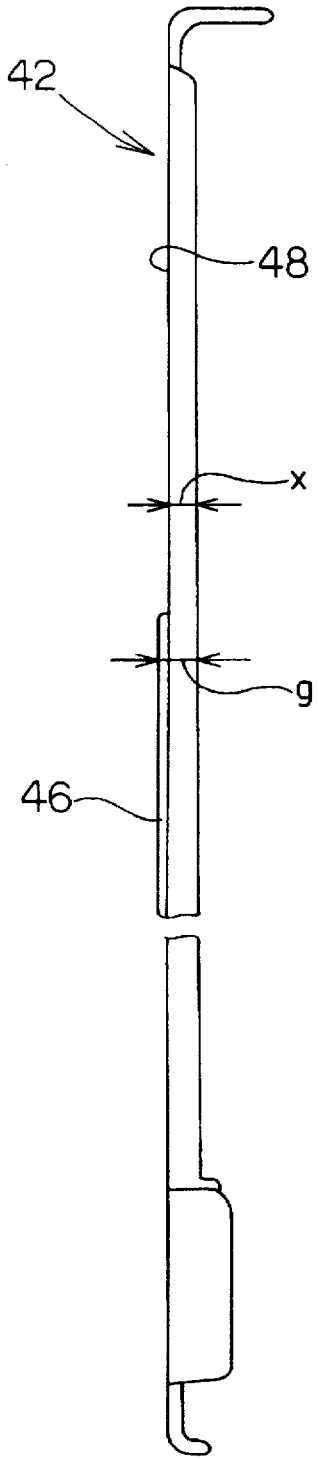
FIG. 14 is a central longitudinal sectional view of a flat pipe of the present invention.
Figure 21:
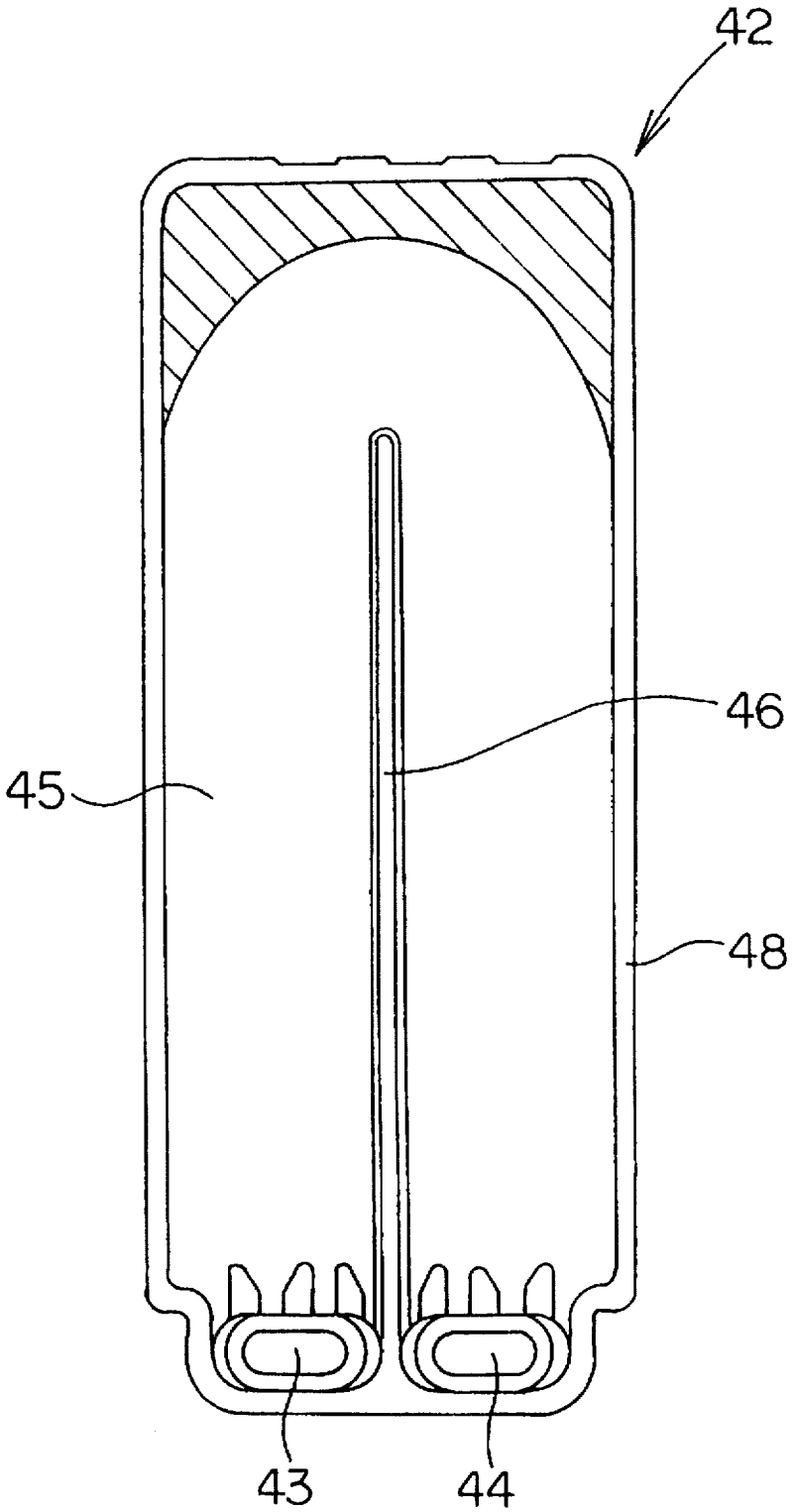
FIG. 21 illustrates a plate for forming a flat pipe.

FIG. 14 shows another embodiment wherein the height x of end edge connecting portions 48 of the plate 42 shown in FIG. 21 is smaller than the height g of the partition ridge 46. With this structure, when the flat tube 41 is formed by two plates 42 being placed one upon the other, the restraint under the assembly work becomes greater particularly in the partition ridge 46 which is the projecting portion. As a result, at the time of brazing these portions integrally at the same time, the projecting portions are firmly brazed first by the brazing material of the inner surfaces of both plates. Then, into the end edge connecting portions 48 the brazing material of the inner and outer surfaces of the plate 42 enters and brazing them together. Even if there is a gap between the end edge connecting portions 48, the gap is filled with the brazing material, thereby to assure joining of the end edge connecting portions 48 firmly.

Figure 15:
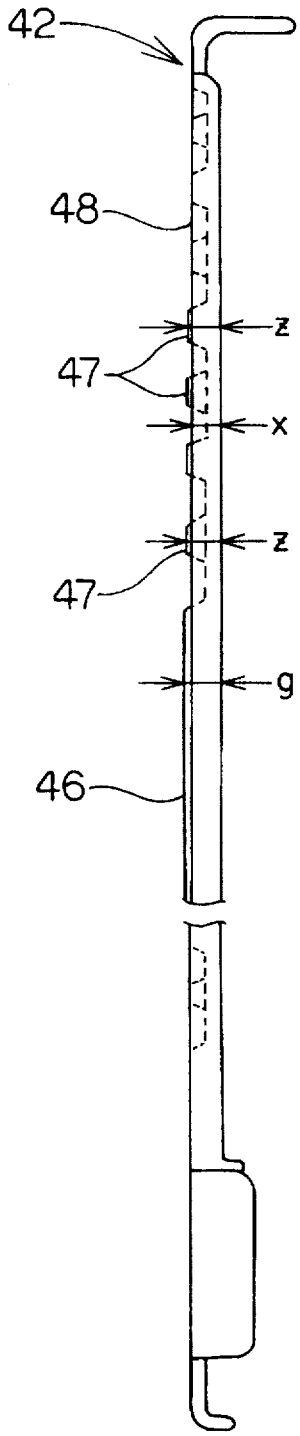
FIG. 15 is a central longitudinal sectional view of the flat pipe of another embodiment of the present invention.
Figure 22:
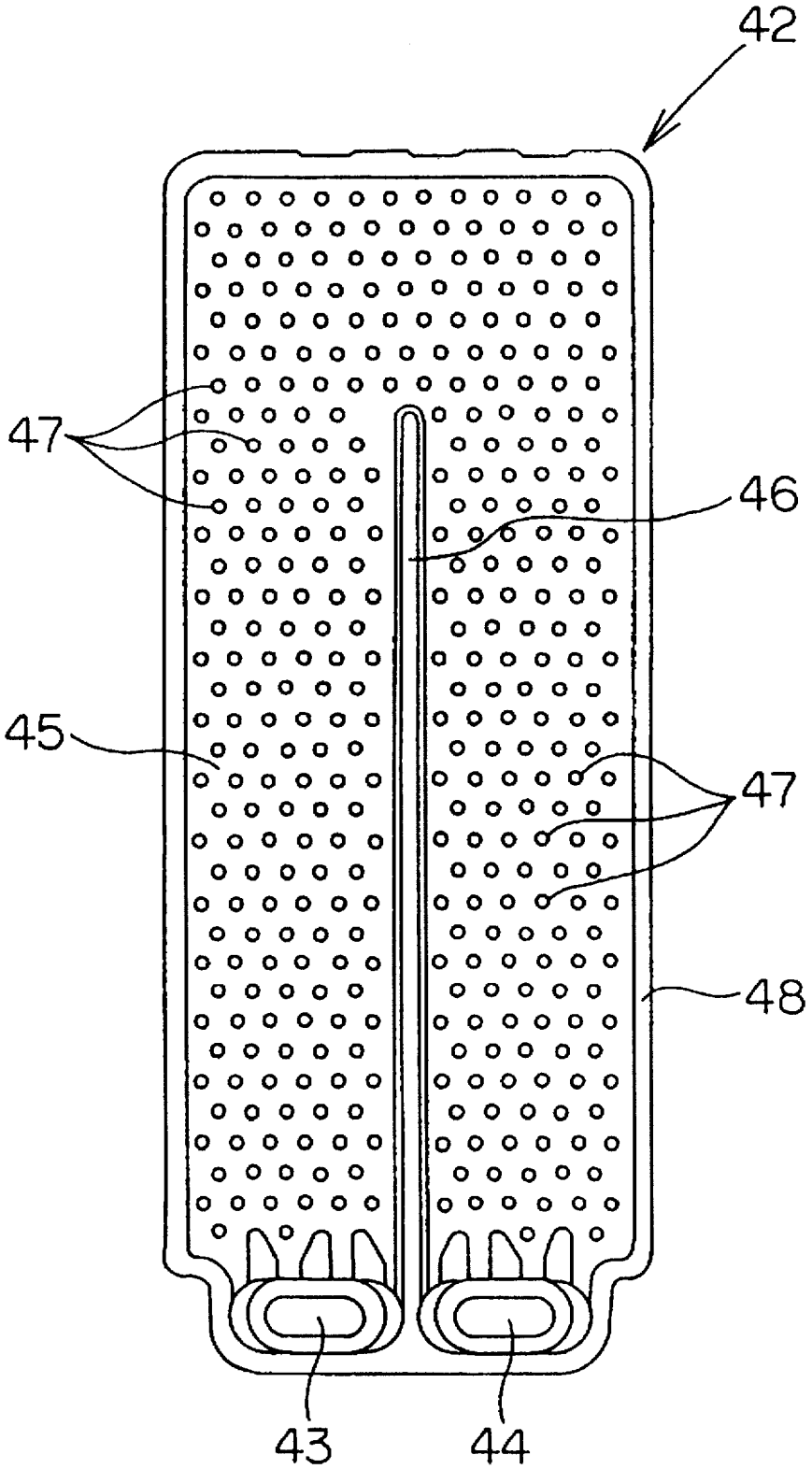
FIG. 22 Illustrates the plate for forming the flat pipe.

An embodiment shown in FIG. 15 is constructed such that the height x of the end edge connecting portions 48 of the plate 42 shown in FIG. 22 is dimensioned smaller than the height g of the partition ridge 46 and the height z of beads 47. In this case there are two modes of dimensioning these portions. One mode is such that the height g of the partition ridge 46 and the height z of beads 47 are dimensioned equal, and the other mode is such that starting from the height g of the partition ridge 46, the height z of beads 47 and to the height x of the end edge connecting portions 48 are dimensioned successively smaller, namely, as g>z>x. In either mode, at least the height g of the partition ridge 46 is the largest, and, consequently, when the flat tube 41 is formed by two plates 42 being placed one upon the other, the restraint under the assembly work becomes greater particularly in the partition ridge 46 which is the projecting portion. As a result, at the time of brazing these portions integrally at the same time, the projecting portions are firmly brazed first by the brazing material of the inner surfaces of both plates. Then, into the end edge connecting portions 48 the brazing material of the inner and outer surfaces of the plate 42 enters and brazing them together. Even if there is a gap between the end edge connecting portions 48, the gap is filled with the brazing material, thereby to assure joining of the end edge connecting portions 48 firmly.

With the plate 42 of the embodiments shown in FIGS. 14 and 15, the forward end of the partition ridge 46 (the upper end of the partition ridge 46 in the drawings) is generally difficult to be brazed properly, and, in view of this, it is advantageous to dimension the forward end portion largest.

Now, assembly and brazing of the tube-stacking type heat exchanger 1 with the above-described structure will be described below.

The tube-stacking type heat exchanger 1 is assembled by stacking a plurality of flat tubes 2 with corrugated fins 3 interposed between the adjacent flat tubes 2, and the ends of each flat tube 2 are inserted into the insertion holes 7 of the header tank 4.

Figure 16:
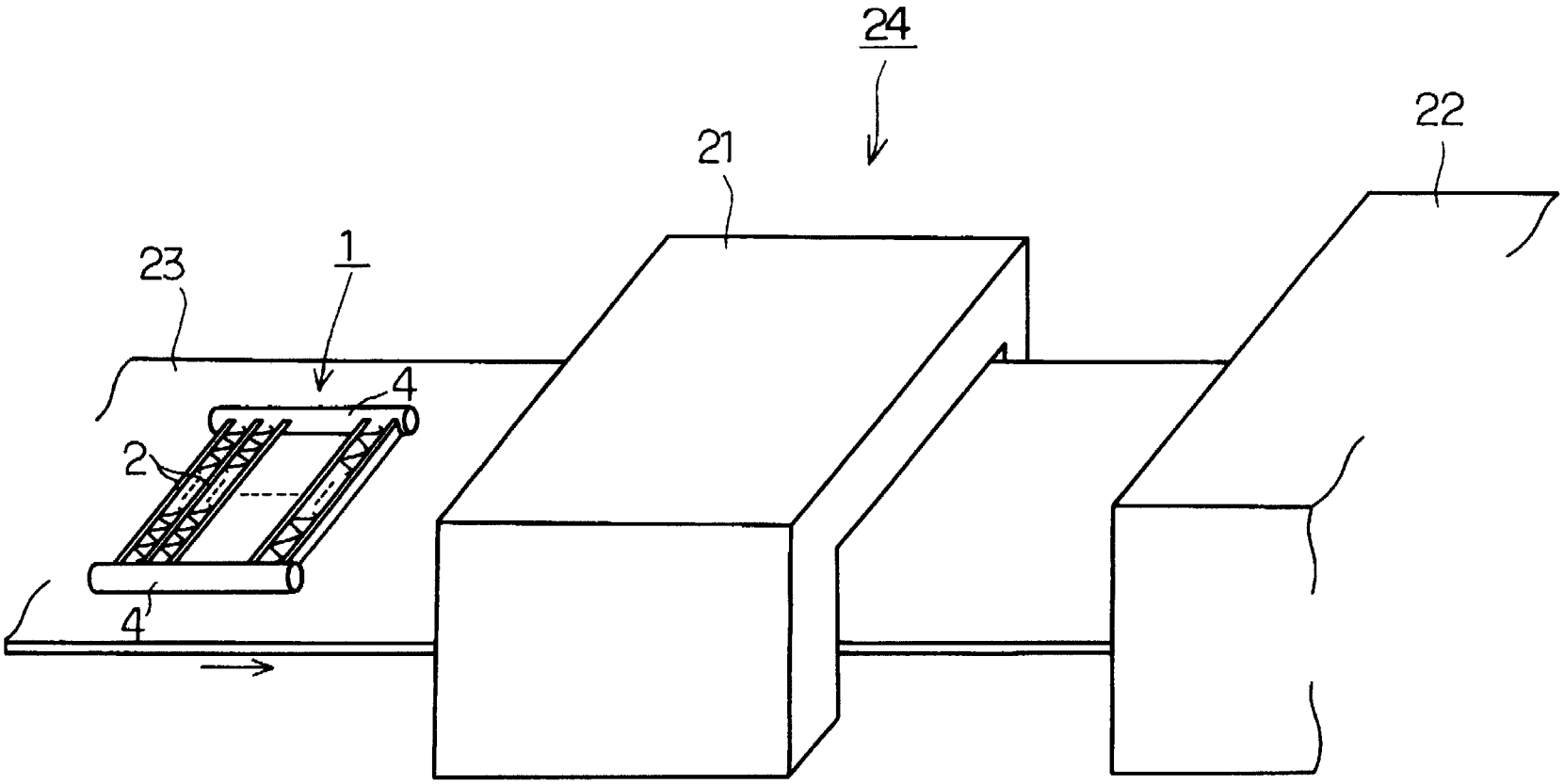
FIG. 16 is a schematic perspective view of brazing device for the heat exchanger.

Then, the assembled heat exchanger 1 is integrally brazed by a brazing apparatus 24 as shown in FIG. 16. The brazing apparatus 24 comprises fluxing means 21 for blasting a shower of liquid flux from up to down on the heat exchanger 1, a brazing furnace 22 for raising a temperature of the fluxed heat exchanger 1 gradually and brazing it after it has been cooled, and a belt conveyer 23 for transporting the heat exchanger 1 into the fluxing means and the brazing furnace successively.

Figure 17:
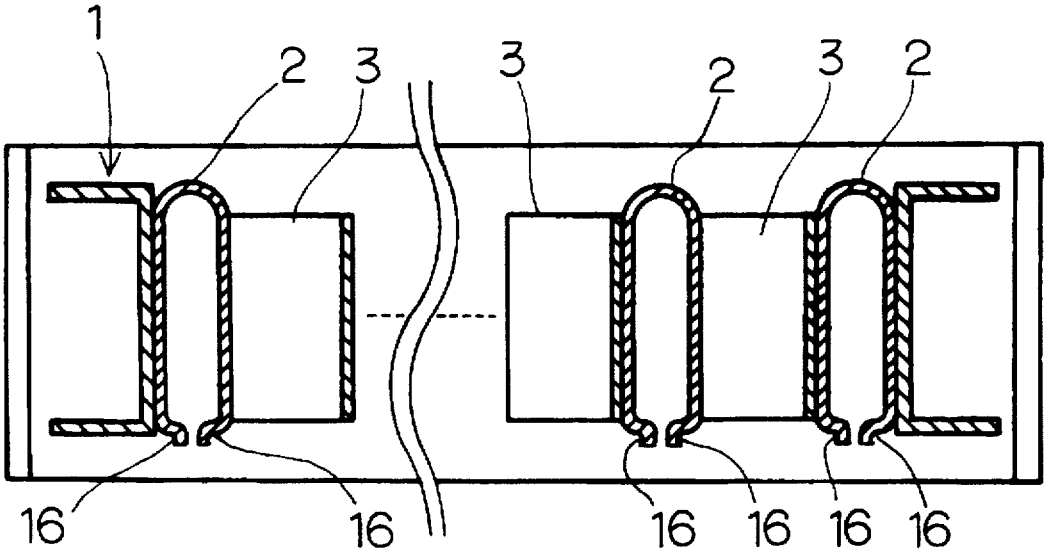
FIG. 17 is a sectional view Illustrating the heat exchanger being transported.
Figure 18:
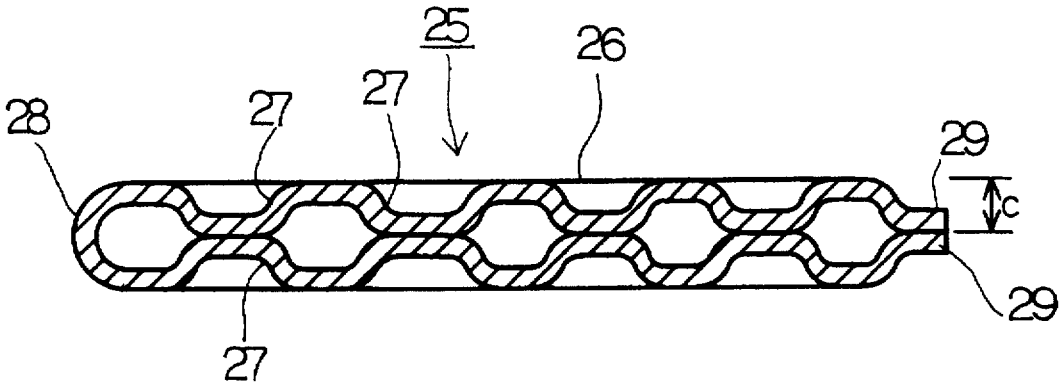
FIG. 18 is a cross-sectional view of the folded type flat tube of prior art.
Figure 19:
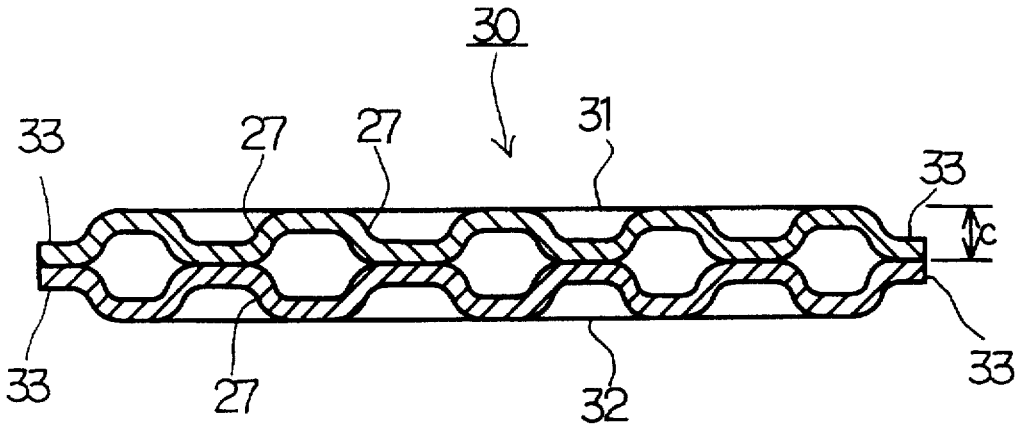
FIG. 19 is a cross-sectional view of the flat tubes placed one upon the other of prior art.
Figure 20:
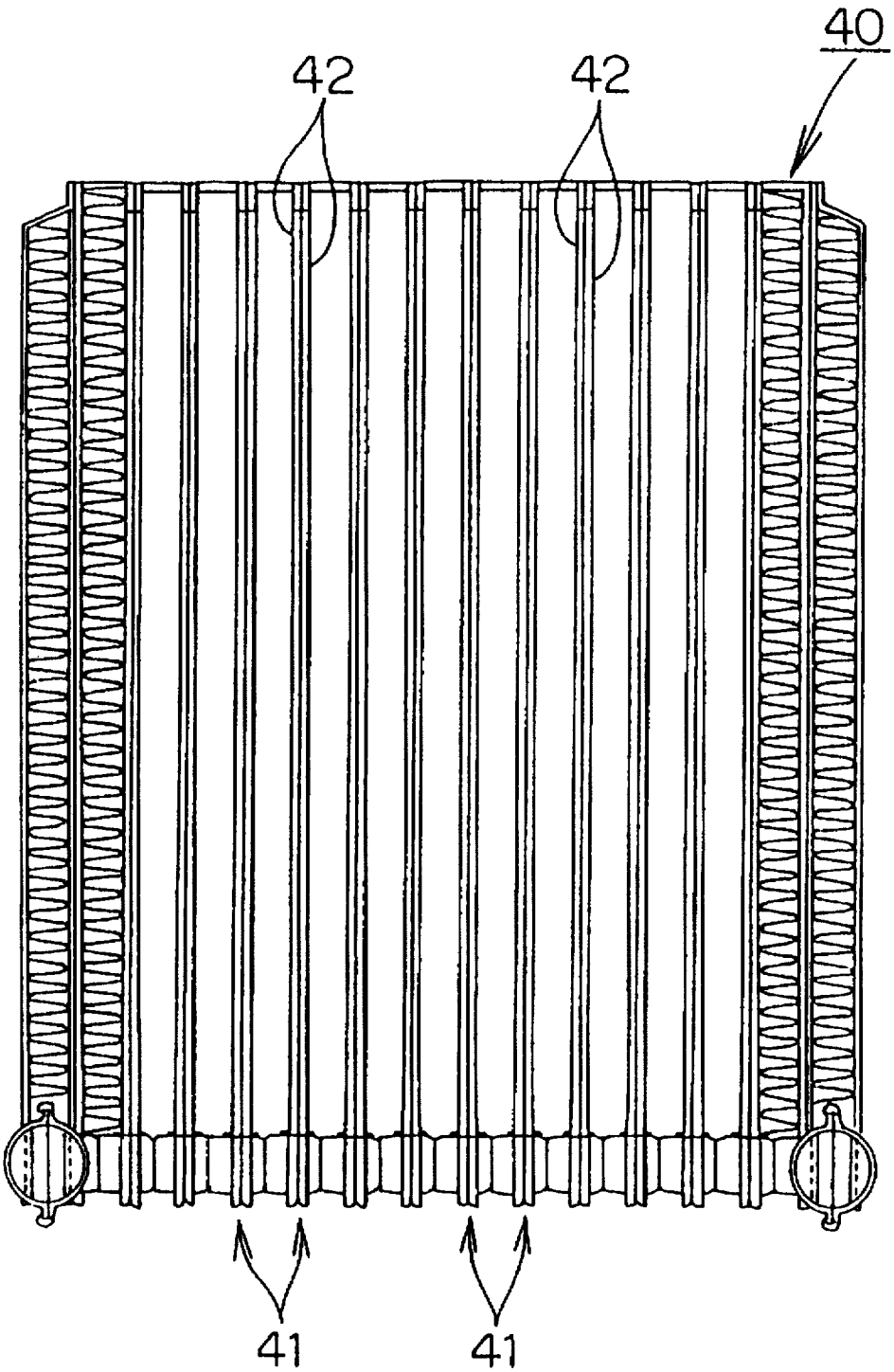
FIG. 20 is a front view of the one-sided tank type of tube-stacking type heat exchanger.

For placing the heat exchanger 1 on the belt conveyer 23, both header tanks 4 are laid on the belt conveyer 23 as shown in FIG. 17.

The heat exchanger 1 after having been fluxed is transported into the furnace 22 by the belt conveyer 23 for brazing. At this point, a gap between the connecting portions 16, 16 of the flat tube is filled with the melted brazing material, thereby the connecting portions 16, 16 are joined together, and other portions are brazed similarly, thereby to manufacture the heat exchanger 1.

In the case where there is only a single connecting portion 16 of the flat tube 2, the heat exchanger 1 should be placed on the belt conveyer with the connecting portion 16 facing downwardly as shown in the drawing. In this manner, the melted brazing material of the inner and outer surfaces of the plate enters around the connecting portion 16 to fill any gaps therein to firmly connect the connecting portion 16.

As it has been described, according to the present invention, the plate which forms the heat-exchanger conduit is so formed that one or both surfaces of plates facing with each other including projecting portions which are projecting from one of the plates towards the other plate. The projecting portions are brought into pressure contact with the projecting portions of other plate or with the flat surface of the other plate, and the end edge connecting portions of the plate are also brought into pressure contact with each other to be brazed, respectively. For this purpose, the height of the end edge connecting portions is dimensioned smaller than the height of the projecting portions. This allows preferential brazing of the projecting portions of the heat-exchanger conduit, and proper brazing of the projecting portions is made possible. This results in improving the heat-resistance of the heat-exchanger conduit to make it suitable for use as a condenser.

Further, since the projecting portions of the heat-exchanger conduit are brazed preferentially, poor brazing, if occurs, will occur not in the projecting portions, but rather in the connecting portions. Then, poor brazing can be easily found by visual observation or leakage of fluid during inspection of the assembled heat exchanger by flowing the fluid therethrough.

What is claimed is:

1. A heat-exchanger conduit comprising:

a pair of rectangular plates having a surface cladded with a brazing material so as to face each other;

a plurality of projections extending inwardly from at least one of said plates; and a pair of connecting portions extending inwardly from and along major sides of each plate, a height of said connecting portions being less than one half of a height of said conduit so that when said plates are joined to form said conduit, there is provided a gap between said connecting portions of said plates to thereby assure brazing all of said projections to the other plate.

2. A heat-exchanger conduit according to claim 1, wherein the conduit is a flat tube and the projections are a plurality of beads.

3. A heat-exchanger conduit according to claim 1, wherein the conduit is a flat pipe, and the projections comprises a partition ridge forming a U-turn passage for a fluid passing therethrough and a plurality of beads arranged around the partition ridge.

4. A heat-exchanger conduit according to claim 1, wherein projections located from a predetermined place to a connecting portion are so arranged that a height of the so-arranged projections is made smaller successively from said predetermined place to the connecting portion.

5. A heat-exchanger conduit comprising:

a rectangular plate having a surface cladded with a brazing material folded along a folding portion to form a conduit;

a plurality of projections extending inwardly from said plate to that a half of said projections are brought into pressure contact with the other half of said projections when said conduit is formed; and a pair of connecting portions extending inwardly from and along major sides of said plate;

a height of said connecting portions being less than a height of said projections so that when said conduit is formed, there is provided a gap between said connecting portions to thereby assure brazing all of said half projections to said other half projections.

* * * * *